US006079209A

United States Patent [19]

Hsu

[11] Patent Number: 6,079,209

[45] Date of Patent: Jun. 27, 2000

[54] HYDRAULIC POWER CONVERSION DEVICE

[76] Inventor: Tien-Lung Hsu, P.O. Box 82-144, Taipei, Taiwan

[21] Appl. No.: 09/229,637

[22] Filed: Jan. 13, 1999

[51] Int. Cl.[7] ..... F15B 7/00

[52] U.S. Cl. ..... 60/581; 60/582

[58] Field of Search ..... 60/533, 581, 582

[56] References Cited

U.S. PATENT DOCUMENTS

| | | | |
|---|---|---|---|
| 4,552,414 | 11/1985 | Fujii et al. | 60/581 X |
| 4,843,819 | 7/1989 | Leiber | 60/581 X |
| 4,848,848 | 7/1989 | Klein | 60/581 X |
| 5,161,449 | 11/1992 | Everett, Jr. | 60/581 X |

*Primary Examiner*—Hoang Nguyen
*Attorney, Agent, or Firm*—A & J

[57] ABSTRACT

A hydraulic power conversion device includes a main oil container having an inlet for supplementing hydraulic oil, a pair of hydraulic pumps connected to the main oil container, a motor drivingly connected with the hydraulic pumps, a twin-circuitry hydraulic cylinder mechanism including a first hydraulic cylinder, a first piston, a piston rod, a sealer, a second piston, a high pressure leakage proof packing and a second hydraulic cylinder, the first hydraulic cylinder having same length as the second hydraulic cylinder but having a smaller diameter than the second hydraulic cylinder, the first hydraulic cylinder being connected with the second hydraulic cylinder by screws, the sealer being fitted between the first and second hydraulic cylinders to form two regions, the second hydraulic cylinder having an inlet provided with a first check valve only allowing hydraulic oil to flow into the second hydraulic cylinder and an outlet provided with a second check valve only allowing hydraulic oil to flow out of the second hydraulic cylinder, an oil retrieving container connected with the inlet of the second hydraulic cylinder, and a hydraulic pressure storage trough connected with the outlet of the second hydraulic cylinder.

3 Claims, 5 Drawing Sheets

HYDRAULIC POWER CONVERSION DEVICE

BACKGROUND OF THE INVENTION

1. Field of the Invention

This invention is related to a hydraulic power conversion device and in particular to one which can output a steady and smooth power to a driving tool.

2. Description of the Prior Art

The conventional power conversion devices fall into two categories, i.e. the electric motor and the internal combustion engine. However, the former requires electric power for operation which is high in cost thereby making it unfit for practical use, while the latter uses the combustion of gasoline or diesel to generate power which will inevitably be accompanied with noise and air pollution.

Therefore, it is an object of the present invention to provide a hydraulic power conversion device which can obviate and mitigate the above-mentioned drawbacks.

SUMMARY OF SAID INVENTION

This invention is related to a hydraulic power conversion device.

According to a preferred embodiment of the present invention, a hydraulic power conversion device includes a main oil container having an inlet for supplementing hydraulic oil, a pair of hydraulic pumps connected to the main oil container, a motor drivingly connected with the hydraulic pumps, a twin-circuitry hydraulic cylinder mechanism including a first hydraulic cylinder, a first piston, a piston rod, a sealer, a second piston, a high pressure leakage proof packing and a second hydraulic cylinder, the first hydraulic cylinder having same length as the second hydraulic cylinder but having a smaller diameter than the second hydraulic cylinder, the first hydraulic cylinder being connected with the second hydraulic cylinder by screws, the sealer being fitted between the first and second hydraulic cylinders to form two regions, the second hydraulic cylinder having an inlet provided with a first check valve only allowing hydraulic oil to flow into the second hydraulic cylinder and an outlet provided with a second check valve only allowing hydraulic oil to flow out of the second hydraulic cylinder, an oil retrieving container connected with the inlet of the second hydraulic cylinder, and a hydraulic pressure storage trough connected with the outlet of the second hydraulic cylinder.

It is the primary object of the present invention to provide a hydraulic power conversion device which can supply steady and smooth power to a driving tool.

It is another object of the present invention to provide a hydraulic power conversion device which will not produce noise and air pollution in use.

It is still another object of the present invention to provide a hydraulic power conversion device which is simple in construction.

It is still another object of the present invention to provide a hydraulic power conversion device which is fit for practical use.

It is still another object of the present invention to provide a hydraulic power conversion device which is easy to manufacture.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
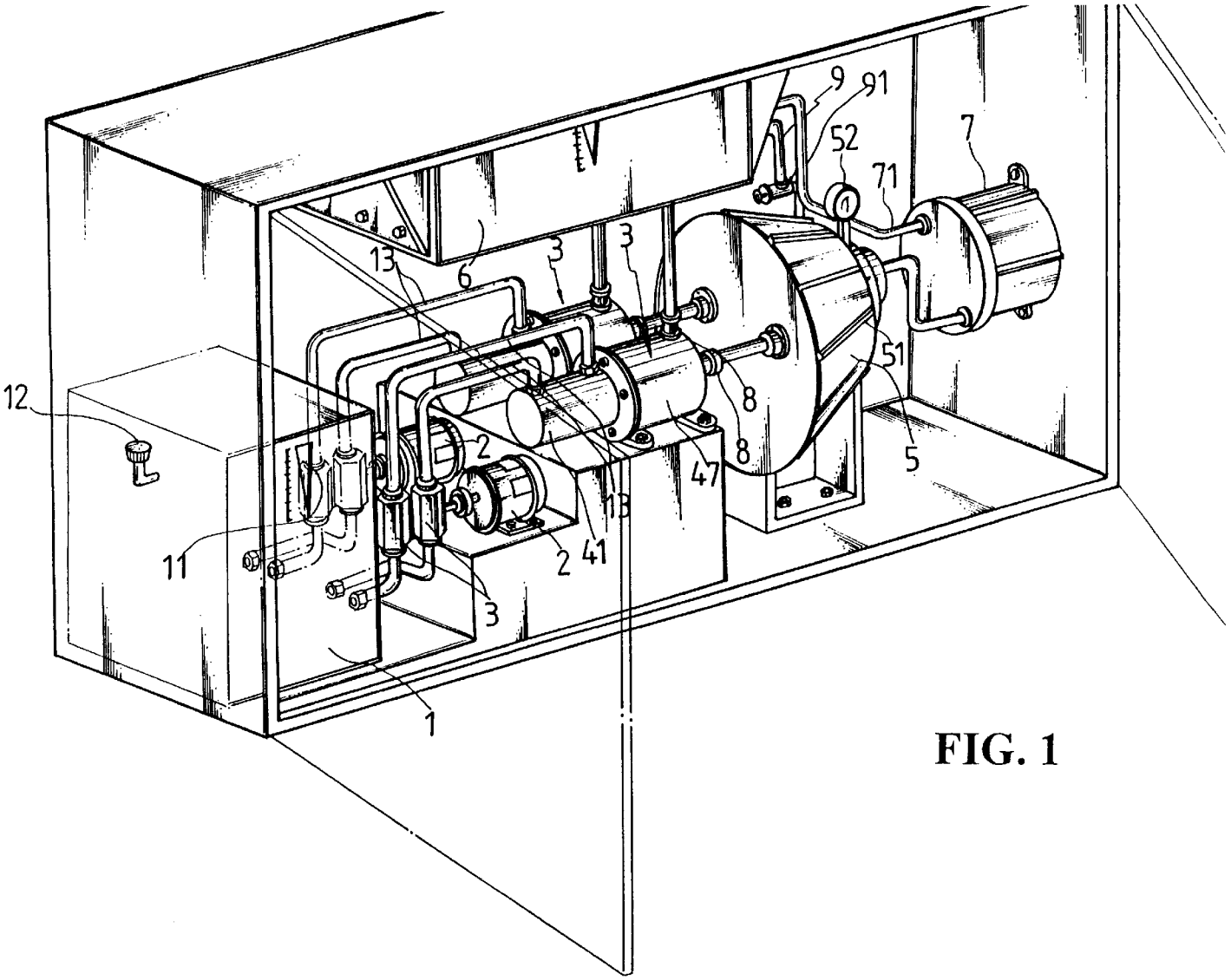
FIG. 1 is a perspective view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

With reference to the drawings and in particular to FIG. 1 thereof, the present invention generally comprises a main oil container 1, a motor 2, a pair of hydraulic pumps 3, a twin-circuitry hydraulic cylinder mechanism 4, a hydraulic pressure storage trough 5, an oil retrieving container 6 and a driving tool 7. The main oil container 1 is used for receiving hydraulic oil and provided with a window 11 for inspection and an inlet 12 for supplementing oil. The main oil container 1 is connected to the two hydraulic pumps 3 and the motor 2 by means of high pressure tubing 13. The motor 2 is used for driving the hydraulic pump 3 to work at high speed thereby forcing the oil to flow from the main oil container 11 into a hydraulic cylinder 41. As shown in FIGS. 3, 3A, 3B and 4, the oil is only used for forcing the piston 42 to reciprocate within the hydraulic cylinder 41.

Figure 2:
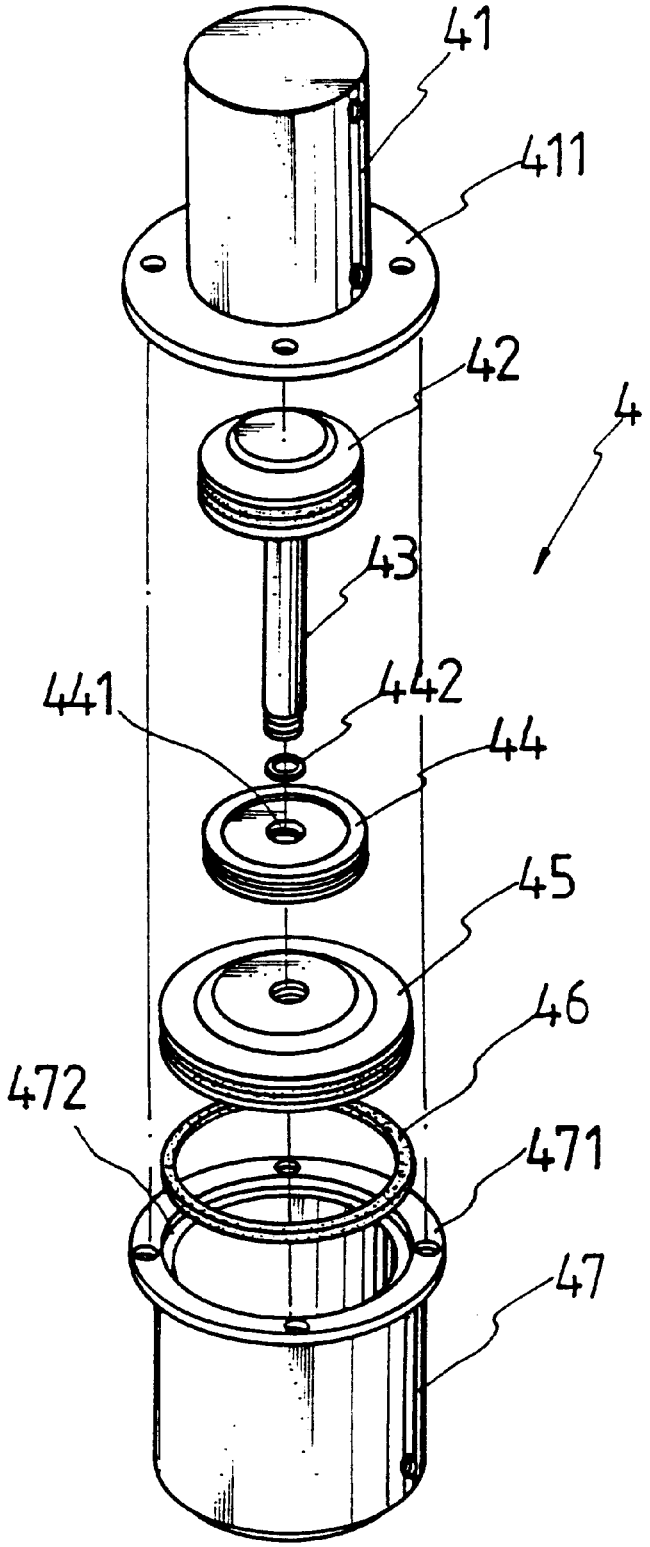
FIG. 2 is an exploded view of the twin-circuitry hydraulic cylinder mechanism.

Referring to FIG. 2, the twin-circuitry hydraulic cylinder mechanism 4 is basically composed of a first hydraulic cylinder 41, a first piston 42, a piston rod 43, a sealer 44, a second piston 45, a high pressure leakage proof packing 46 and a second hydraulic cylinder 47. The first hydraulic cylinder 41 has the same length as the second hydraulic cylinder 47, but has a smaller diameter than the second hydraulic cylinder 47. The two hydraulic cylinders 41 and 47 have the same stroke and move at the same speed. As the second hydraulic cylinder 47 has a larger diameter than the first hydraulic cylinder 41, the second hydraulic cylinder 47 has a higher flow rate than the first hydraulic cylinder 41. The first hydraulic cylinder 41 is provided with a flange 411 adapted to engage with a flange 471 of the second hydraulic cylinder 47 so that the two hydraulic cylinders 41 and 47 can be secured together by screws. The sealer 44 is fitted in the open end of the first hydraulic cylinder 41 for separating the two hydraulic cylinders 41 and 47 into two regions. The oil of the hydraulic cylinders 41 and 47 are supplied by the main oil container 11 and the oil-retrieving container 6, respectively. The piston rod 43 extends through a center hole 441 of the sealer 44 (see FIG. 2). A packing ring 442 is fitted in the center hole 441 for sealing the clearance between the piston rod 43 and the center hole 441, with the piston rod 43 reciprocating through the center hole 441. The first piston 42 and the second piston 45 are each threadedly engaged with an end of the piston rod 43, so that when the hydraulic oil is forced to push the first piston 42, the piston rod 43 will be moved toward the sealer 44 thereby moving the second piston 45 to force the hydraulic oil into the hydraulic pressure storage trough 5, as shown in FIGS. 3, 3A, 3B and 4.

Figure 3:
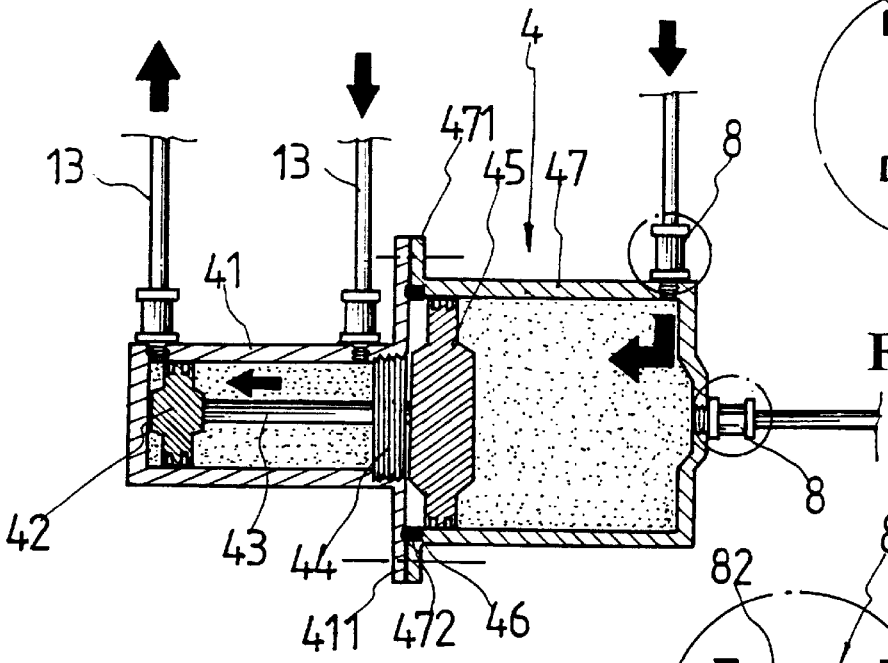
FIG. 3 is a sectional view of the twin-circuitry hydraulic cylinder mechanism.
Figure 3A:
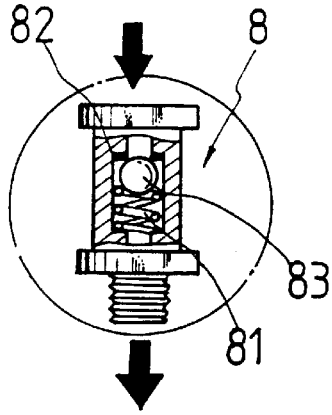
FIG. 3A is a sectional view of the check valve mounted at the inlet of the twin-circuitry hydraulic cylinder mechanism.
Figure 3B:
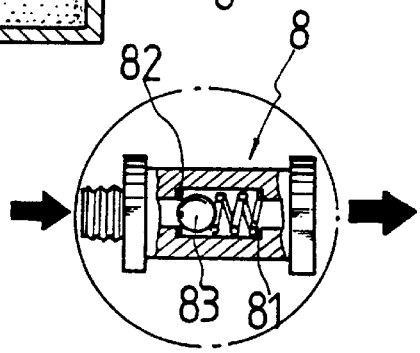
FIG. 3B is a sectional view of the check valve mounted at the outlet of the twin-circuitry hydraulic cylinder mechanism.
Figure 4:
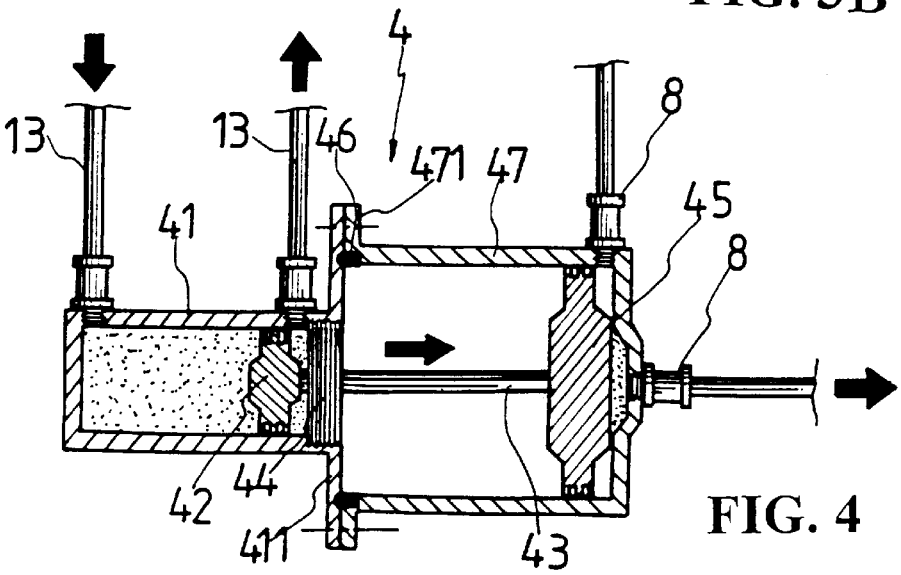
FIG. 4 illustrates the working principle of the twin-circuitry hydraulic cylinder mechanism.

Looking now at FIGS. 1, 3, 3A, 3B and 4, the hydraulic cylinder 41 receives hydraulic oil from the main oil container 1 thereby forming a small circulatory system, while the second hydraulic cylinder 47 receives hydraulic oil from the oil retrieving container 6 thus forming a large circulatory system with the hydraulic pressure storage trough 5 and the driving tool 7. The second hydraulic cylinder 47 is provided with a check valve 8 at both the inlet and outlet thereof. The check valve 8 includes a spring 81, a packing ring 82 and a steel ball 83, as shown in FIGS. 3A and 3B. As the second piston 45 is moved toward the first hydraulic cylinder 41, the second hydraulic cylinder 47 will become vacuum thereby attracting the steel ball 83 to move inwardly and therefore opening the check valve 8. Hence, the hydraulic oil is rapidly filled into the second hydraulic cylinder 47 from the oil retrieving container 6. In the meantime, the check valve 8 at the outlet of the second hydraulic cylinder 47 enables hydraulic oil to flow out from the second hydraulic cylinder 47 only. When the second piston 45 is forced to move away from the sealer 44, the check valve 8 at the inlet of the second hydraulic cylinder 47 is closed, but the check valve at the outlet of the second hydraulic cylinder 47 is open thereby enabling the hydraulic oil to flow into the hydraulic pressure storage trough 5 from the second hydraulic cylinder 47.

Figure 5A:
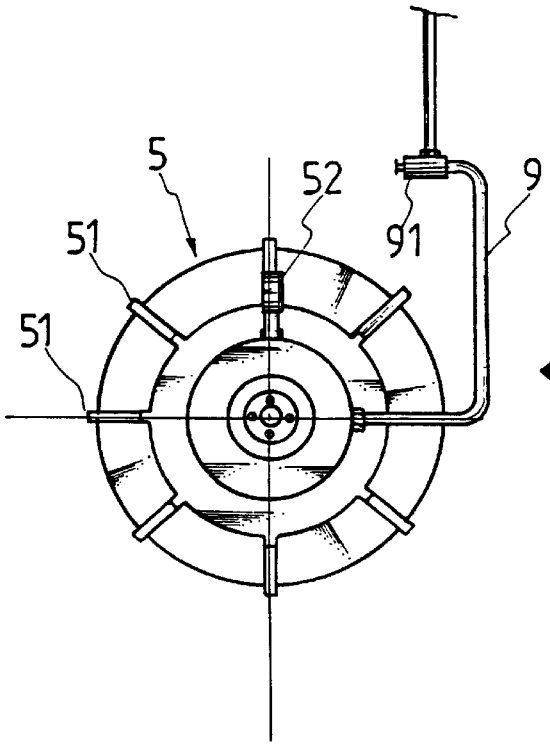
FIG. 5A is a front view of the hydraulic pressure storage trough.
Figure 5B:
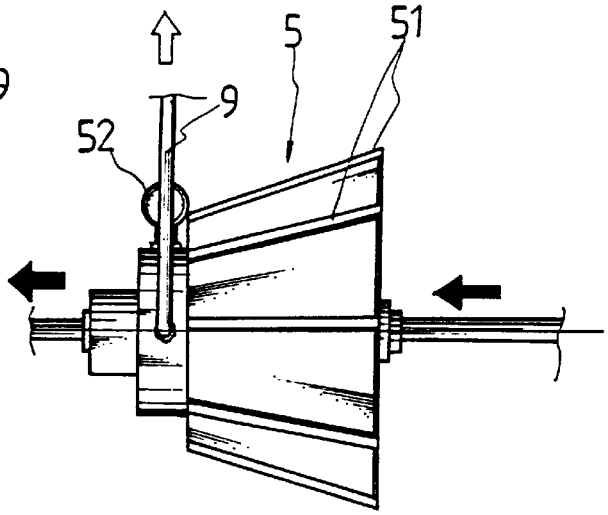
FIG. 5B is a side view of the hydraulic pressure storage trough.
Figure 6:
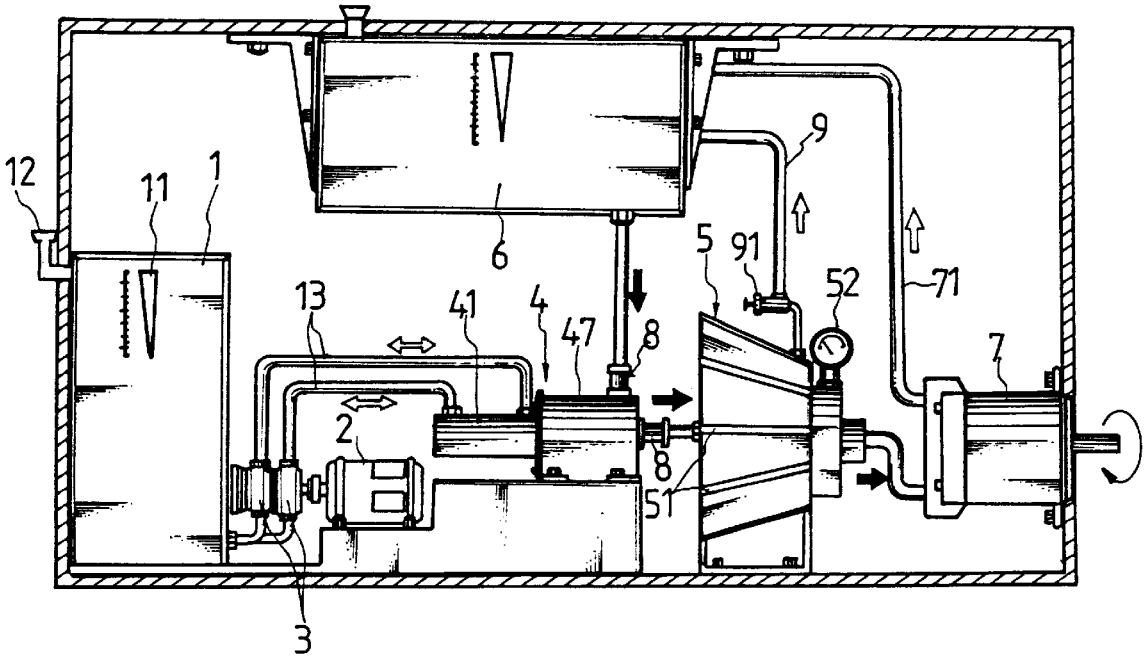
FIG. 6 is a side view of the present invention.

Looking now at FIG. 5, the hydraulic pressure storage trough 5 is provided with a plurality of ribs 51 at the outer side for reinforcing the structure thereof. A pressure gauge 52 and a high pressure relief piping 9 are mounted on the hydraulic pressure storage trough 5. If the internal pressure exceeds the predetermined value, a relief valve 91 will be open to transmit the hydraulic oil back to the oil retrieving container 6 thereby ensuring safety. Referring to FIG. 6, the present invention utilizes the twin-circuitry hydraulic cylinder mechanism 4 as a power source, and provides a small circulatory system constituted by the first hydraulic cylinder 41, the main oil container 1, the motor 2 and the hydraulic pump 3 and a large circulatory system constituted by the second hydraulic cylinder 47, the hydraulic pressure storage trough 5, the driving tool 7 and the oil retrieving container 6. By means of the large circulatory system, the driving tool 7 will be driven to supply power to a high loading device. After use, the hydraulic oil will be fed back to the oil retrieving container 6 via a pipe 71.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A hydraulic power conversion device comprising:

a main oil container having an inlet for supplementing hydraulic oil;

a pair of hydraulic pumps connected to said main oil container;

a motor drivingly connected with said hydraulic pumps;

a twin-circuitry hydraulic cylinder mechanism including a first hydraulic cylinder, a first piston, a piston rod, a sealer, a second piston, a high pressure leakage proof packing and a second hydraulic cylinder, said first hydraulic cylinder having same length as said second hydraulic cylinder but having a smaller diameter than said second hydraulic cylinder, said first hydraulic cylinder being connected with said second hydraulic cylinder by screws, said sealer being fitted between said first and second hydraulic cylinders to form two regions, said second hydraulic cylinder having an inlet provided with a first check valve only allowing hydraulic oil to flow into said second hydraulic cylinder and an outlet provided with a second check valve only allowing hydraulic oil to flow out of said second hydraulic cylinder; and an oil retrieving container connected with said inlet of said second hydraulic cylinder;

a hydraulic pressure storage trough connected with said outlet of said second hydraulic cylinder.

2. Said hydraulic power conversion device as claimed in claim 1, wherein said hydraulic pressure storage trough is provided with a relief valve which is in turn connected with said oil retrieving container.

3. Said hydraulic power conversion device as claimed in claim 1, wherein each of said first and second check valves includes a packing ring, a steel ball, a spring urging said steel ball against said packing ring.

* * * * *